US009946283B1

(12) United States Patent
Yung et al.

(10) Patent No.: US 9,946,283 B1
(45) Date of Patent: Apr. 17, 2018

(54) FAST TRANSIENT RESPONSE LOW-DROPOUT (LDO) REGULATOR

(71) Applicant: QUALCOMM Incorporated, San Diego, CA (US)

(72) Inventors: Chi Fan Yung, Singapore (SG); Xiaodan Zou, Singapore (SG); Ngai Yeung Ho, San Diego, CA (US); Kan Li, Singapore (SG); Hua Guan, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/296,608

(22) Filed: Oct. 18, 2016

(51) Int. Cl.
*G05F 1/575* (2006.01)

(52) U.S. Cl.
CPC ..... *G05F 1/575* (2013.01)

(58) Field of Classification Search
CPC ..... G05F 1/468; G05F 1/56; G05F 1/575
USPC ..... 323/273, 280, 281
See application file for complete search history.

(56) References Cited

U.S. PATENT DOCUMENTS 5,631,598 A * 5/1997 Miranda ..... G05F 1/565 327/483
6,046,577 A 4/2000 Rincon-Mora et al.
6,147,550 A 11/2000 Holloway
6,188,211 B1 2/2001 Rincon-Mora et al.
6,586,917 B1 * 7/2003 Smith ..... G05F 1/565 320/145
6,791,390 B2 * 9/2004 Gay ..... G05F 3/242 323/225
7,492,137 B2 * 2/2009 Yamada ..... G05F 1/565 323/280
7,504,814 B2 3/2009 Lee et al.
7,548,051 B1 6/2009 Tenbroek et al.
8,294,441 B2 10/2012 Gurcan et al.
9,588,541 B1 3/2017 Ho et al.
2003/0224624 A1 12/2003 Gay
(Continued)

FOREIGN PATENT DOCUMENTS

EP 1253498 A1 10/2002

OTHER PUBLICATIONS

Akhamal H., et al., "Fast Transient Response Low Drop-out Voltage Regulator," International Journal of Embedded Systems and Applications (IJESA), Sep. 2014, vol. 4, No. 2/3, pp. 1-10.
(Continued)

*Primary Examiner* — Jeffrey Sterrett
(74) *Attorney, Agent, or Firm* — Patterson & Sheridan, L.L.P.

(57) ABSTRACT

Certain aspects of the present disclosure generally relate a dual feedback loop regulator. For example, the regulator may include a first amplifier having an output coupled to an output node of the regulator, the output node further coupled to a first feedback path and a second feedback path of the regulator. A first input of a second amplifier may be coupled to the first feedback path and a second input of the second amplifier may be coupled to a reference path. The regulator may also include a transconductance stage having a first transistor and a first current source, the first transistor and the current source coupled to the first feedback path and the second feedback path, and a transimpedance stage coupled to the transconductance stage and an input of the first amplifier.

26 Claims, 6 Drawing Sheets

(56) References Cited

U.S. PATENT DOCUMENTS

2005/0189930 A1* 9/2005 Wu ..... G05F 1/575 323/280
2005/0248331 A1* 11/2005 Whittaker ..... G05F 1/575 323/313
2006/0164053 A1 7/2006 Walter et al.
2006/0181258 A1 8/2006 Benbrik
2007/0139030 A1 6/2007 Lee et al.
2007/0242536 A1 10/2007 Matsubara
2008/0278127 A1* 11/2008 Nagata ..... G05F 1/56 323/276
2008/0303496 A1* 12/2008 Schlueter ..... G05F 1/575 323/273
2009/0189591 A1 7/2009 Sperling et al.
2010/0213917 A1* 8/2010 Pulijala ..... G05F 1/575 323/293
2013/0221940 A1* 8/2013 Yan ..... G05F 1/565 323/273
2014/0139198 A1 5/2014 Manlove et al.
2014/0266103 A1 9/2014 Wang et al.
2014/0277812 A1 9/2014 Shih et al.
2015/0103566 A1 4/2015 Keogh et al.
2015/0168969 A1 6/2015 Shor
2015/0192943 A1 7/2015 Roham et al.
2015/0349622 A1 12/2015 Lo et al.
2016/0349776 A1* 12/2016 Conte ..... G05F 1/575

OTHER PUBLICATIONS

Rincon-Mora G.A., et al., "A Low-Voltage, Low Quiescent Current, Low Drop-Out Regulator," IEEE Journal of Solid-State Circuits, Jan. 1998, vol. 33, No. 1, pp. 36-44.

Lu Y., et al., "A 0.65ns-Response-Time 3.01 ps FOM Fully-Integrated Low-Dropout Regulator with Full-Spectrum Power-Supply- Rejection for Wideband Communication Systems," IEEE International Solid-State Circuits Conference, Technical Papers, Feb. 2014, pp. 306-307. Retrieved from the Internet: URL:http://www.researchgate.net/publication/271550565.

* cited by examiner

FAST TRANSIENT RESPONSE LOW-DROPOUT (LDO) REGULATOR

TECHNICAL FIELD

Certain aspects of the present disclosure generally relate to electronic circuits and, more particularly, to a circuit for a regulator.

BACKGROUND

Power management integrated circuits (power management ICs or PMIC) are used for managing the power requirement of a host system. A PMIC may be used in battery-operated devices, such as mobile phones, tablets, laptops, wearables, etc., to control the flow and direction of electrical power in the devices. The PMIC may perform a variety of functions for the device such as DC to DC conversion, battery charging, power-source selection, voltage scaling, power sequencing, etc. For example, a PMIC may be used for voltage regulation and may feature a low-dropout (LDO) regulator.

SUMMARY

Certain aspects of the present disclosure generally relate to a dual feedback loop regulator.

Certain aspects of the present disclosure provide a regulator. The regulator generally includes a first amplifier having an output coupled to an output node of the regulator. In certain aspects, the output node is further coupled to a first feedback path and a second feedback path of the regulator. The regulator further includes a second amplifier having a first input coupled to the first feedback path and a second input coupled to a reference path. The regulator further includes a transconductance stage having a first transistor and a first current source. In certain aspects, the first transistor and the current source are coupled to the first feedback path and the second feedback path. The regulator further includes a transimpedance stage coupled to the transconductance stage and an input of the first amplifier.

Certain aspects of the present disclosure provide a regulator. The regulator generally includes a first amplifier having an output coupled to an output node of the regulator and a feedback path. The regulator further includes a second amplifier having a first input coupled to the feedback path and a second input coupled to a reference path. The regulator further includes a transconductance stage having a first transistor. In certain aspects, the first transistor has a gate coupled to an output of the second amplifier and a source of the first transistor is coupled to the output node. The regulator further includes a transimpedance stage coupled to the transconductance stage and an input of the first amplifier.

Certain aspects of the present disclosure provide a method for signal regulation. The method generally includes generating an output signal based on a control voltage. The method further includes comparing the output signal and a reference signal. The method further includes generating another reference signal based on the comparison. The method further includes generating a current via a first transistor. In certain aspects, the transistor has a gate to source voltage (Vgs) comprising a difference between a voltage of the other reference signal and a voltage of the output signal. The method further includes generating the control voltage based on the current.

Certain aspects of the present disclosure provide an apparatus for signal regulation. The apparatus generally includes means for generating an output signal based on a control voltage. The apparatus further includes means for comparing the output signal and a reference signal. The apparatus further includes means for generating another reference signal based on the comparison. The apparatus further includes means for generating a current. The means for generating the current comprises a transistor. In certain aspects, the transistor has a gate to source voltage (Vgs) comprising a difference between a voltage of the other reference signal and a voltage of the output signal. The apparatus further includes means for generating a control voltage based on the current.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

The techniques described herein may be used in combination with various wireless technologies such as Code Division Multiple Access (CDMA), Orthogonal Frequency Division Multiplexing (OFDM), Time Division Multiple Access (TDMA), Spatial Division Multiple Access (SDMA), Single Carrier Frequency Division Multiple Access (SC-FDMA), Time Division Synchronous Code Division Multiple Access (TD-SCDMA), and so on. Multiple user terminals can concurrently transmit/receive data via different (1) orthogonal code channels for CDMA, (2) time slots for TDMA, or (3) sub-bands for OFDM. A CDMA system may implement IS-2000, IS-95, IS-856, Wideband-CDMA (W-CDMA), or some other standards. An OFDM system may implement Institute of Electrical and Electronics Engineers (IEEE) 802.11, IEEE 802.16, Long Term Evolution (LTE) (e.g., in TDD and/or FDD modes), or some other standards. A TDMA system may implement Global System for Mobile Communications (GSM) or some other standards. These various standards are known in the art.

An Example Wireless System

Figure 1:
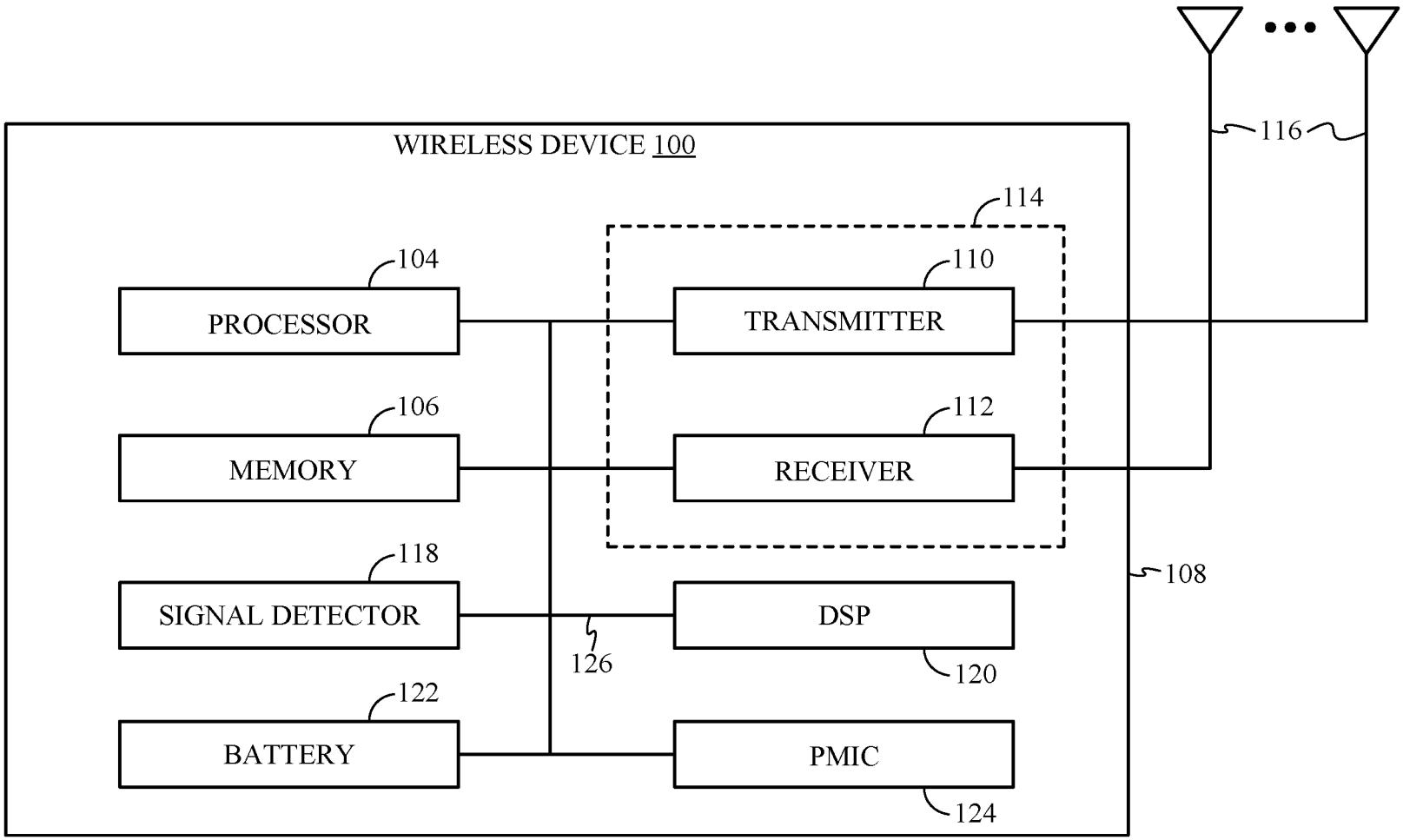
FIG. 1 illustrates a block diagram of an example device including a voltage regulator, according to certain aspects of the present disclosure.

FIG. 1 illustrates a device 100. The device 100 may be a battery-operated device such as a cellular phone, a personal digital assistant (PDA), a handheld device, a wireless modem, a laptop computer, a tablet, a personal computer, etc. The device 100 is an example of a device that may be configured to implement the various systems and methods described herein.

The device 100 may include a processor 104 which controls operation of the device 100. The processor 104 may also be referred to as a central processing unit (CPU). Memory 106, which may include both read-only memory (ROM) and random access memory (RAM), provides instructions and data to the processor 104. A portion of the memory 106 may also include non-volatile random access memory (NVRAM). The processor 104 typically performs logical and arithmetic operations based on program instructions stored within the memory 106. The instructions in the memory 106 may be executable to implement the methods described herein.

The device 100 may also include a housing 108 that may include a transmitter 110 and a receiver 112 to allow transmission and reception of data between the device 100 and a remote location. The transmitter 110 and receiver 112 may be combined into a transceiver 114. A plurality of transmit antennas 116 may be attached to the housing 108 and electrically coupled to the transceiver 114. The device 100 may also include (not shown) multiple transmitters, multiple receivers, and multiple transceivers.

The device 100 may also include a signal detector 118 that may be used in an effort to detect and quantify the level of signals received by the transceiver 114. The signal detector 118 may detect such signals as total energy, energy per subcarrier per symbol, power spectral density and other signals. The device 100 may also include a digital signal processor (DSP) 120 for use in processing signals.

The device 100 may further include a battery 122 used to power the various components of the device 100. The device 100 may also include a power management integrated circuit (power management IC or PMIC) 124 for managing the power from the battery to the various components of the device 100. The PMIC 124 may perform a variety of functions for the device such as DC to DC conversion, battery charging, power-source selection, voltage scaling, power sequencing, etc. In certain aspects, the PMIC 124 includes a voltage regulator (e.g., low-dropout regulator (LDO)) as described herein, and may be used for voltage regulation.

The various components of the device 100 may be coupled together by a bus system 126, which may include a power bus, a control signal bus, and a status signal bus in addition to a data bus.

Example Fast Transient Response Low-Dropout (LDO) Regulator

Certain aspects of this present disclosure generally relate to a voltage regulator (e.g., LDO) implemented using dual feedback loops. Dual feedback loops, as described herein, may provide several advantages, including improving the transient response of the regulator. That is, for the same output capacitor size, a faster transient response may be obtained as compared to a regulator with only a single feedback loop. Faster transient response leads to smaller undershoot and/or overshoot of the output voltage of the regulator in response to a load attack (e.g., increased load current). Therefore, by improving the transient response with a dual loop implementation, the size of the output capacitor may be reduced reducing bill of material (BOM) costs. Moreover, improving the transient response increases the recovery speed of the output voltage in response to a load attack, which is an especially desirable feature for regulators driving a digital load. A tighter regulator output voltage may translate to improved overall system efficiency. In addition, aspects of the present disclosure may allow for a separation of the controller from the power stage of the regulator, allowing for the controller to be used for multiple power stages. Separating the controller from the power stage may provide increased flexibility for top-level floor planning. Further, in certain aspects, sharing the controller for multiple power stages may reduce the overall die area used to implement controllers.

Voltage regulators, such as a LDO regulator, may include a power transistor and a differential amplifier. In some implementations, such as for implementations to be used for higher voltage outputs, a p-channel metal-oxide semiconductor (PMOS) transistor may be used over an n-channel metal-oxide semiconductor (NMOS) transistor. For example, the PMOS transistor may use a lower gate drive voltage than an NMOS transistor. However, the PMOS transistor may have a lower carrier mobility than an NMOS transistor, and therefore a larger area may be dedicated for the PMOS transistor. Accordingly, in certain aspects, it may be beneficial to use a NMOS transistor instead of a PMOS transistor in a voltage regulator to reduce the size of the voltage regulator. However, as discussed above, an NMOS transistor may use a higher gate drive voltage than a PMOS transistor.

Figure 2:
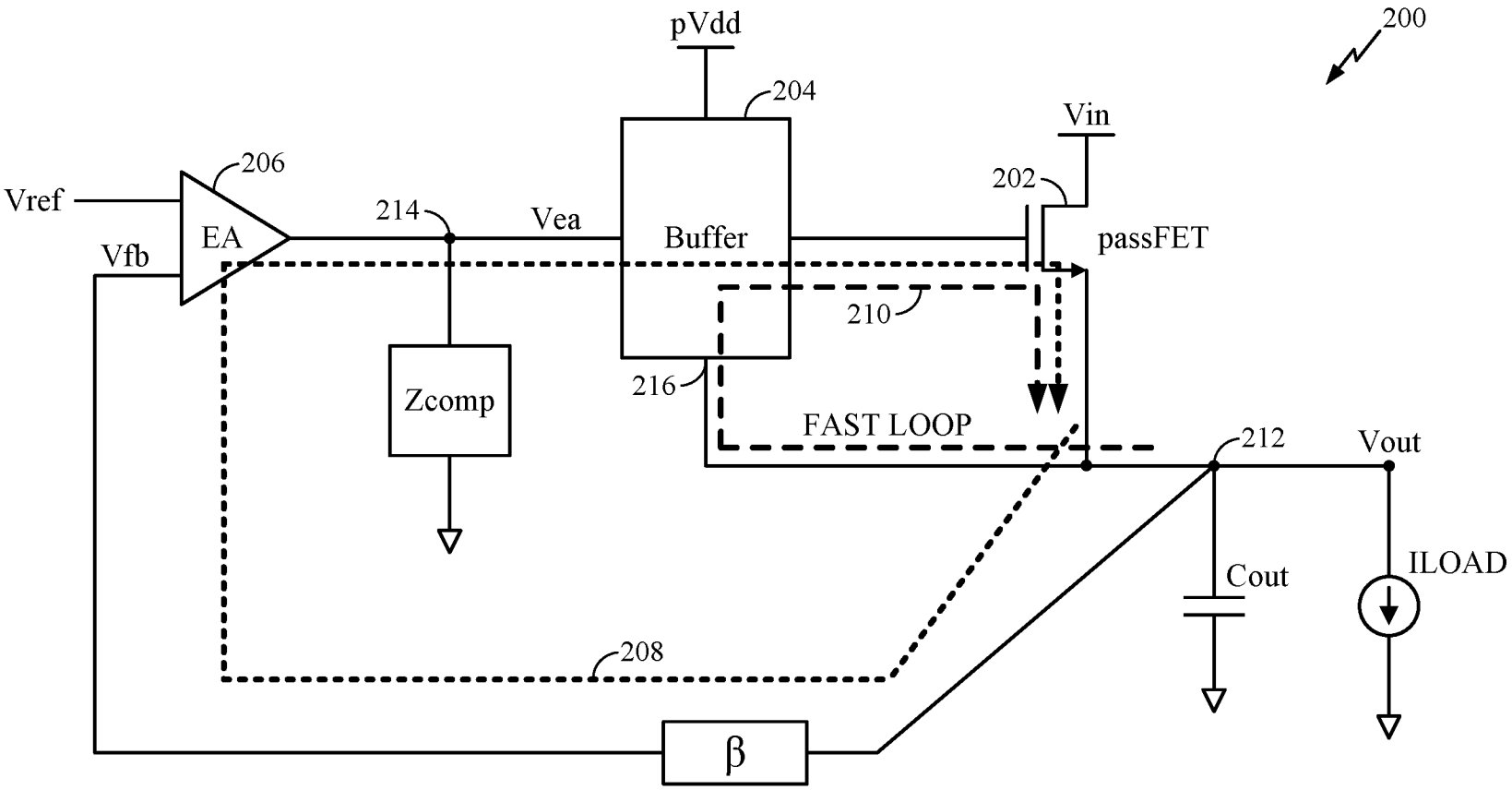
FIG. 2 illustrates an example dual-loop regulator, in accordance with certain aspects of the present disclosure.

FIG. 2 illustrates an example dual-loop regulator 200, in accordance with certain aspects of the present disclosure. As illustrated, the regulator 200 is implemented using an NMOS transistor (e.g., passFET) 202 having a drain coupled to an input voltage Vin and a source coupled to the output node 212 to generate the output voltage Vout. A buffer 204 may be used to buffer an output signal of an amplifier 206 to drive a gate of the transistor 202 (e.g., error amplifier (EA)). The buffer 204 may be powered by a positive voltage rail pVdd. The amplifier 206 adjusts the output voltage Vout based on a reference voltage Vref. For example, the amplifier 206 generates a reference voltage Vea at node 214 that is input to the buffer 204 by comparing the reference voltage Vref and a feedback voltage Vfb received from a feedback path 208. For example, the amplifier 206 may adjust the reference voltage Vea at node 214 in an attempt to force its inputs (e.g., signals Vref and Vfb) to be the same. In certain aspects, a gain stage (β) may be implemented for the feedback path 208. In certain aspects, an impedance Zcomp may be coupled between the node 214 and a reference potential for the regulator 200.

Aspects of the present disclosure implement a second feedback path (e.g., fast loop) 210. For example, a reference potential node 216 of the buffer 204 may be coupled to the output node 212, as illustrated, to form the second feedback path 210. The feedback path 210 allows the buffer 204 to respond to voltage fluctuations at the output node 212 more quickly by providing a direct feedback path to the buffer 204 from the output node 212. That is, without the feedback path 210, voltage fluctuations at the output node 212 would only be fed back to the amplifier 206, and any response to the voltage fluctuation would be impacted by the delay associated with the operation of the amplifier 206. Therefore, with the feedback path 210, the regulator 200 can more quickly respond to voltage fluctuations at the output node 212, improving the transient response of the regulator 200.

Figure 3:
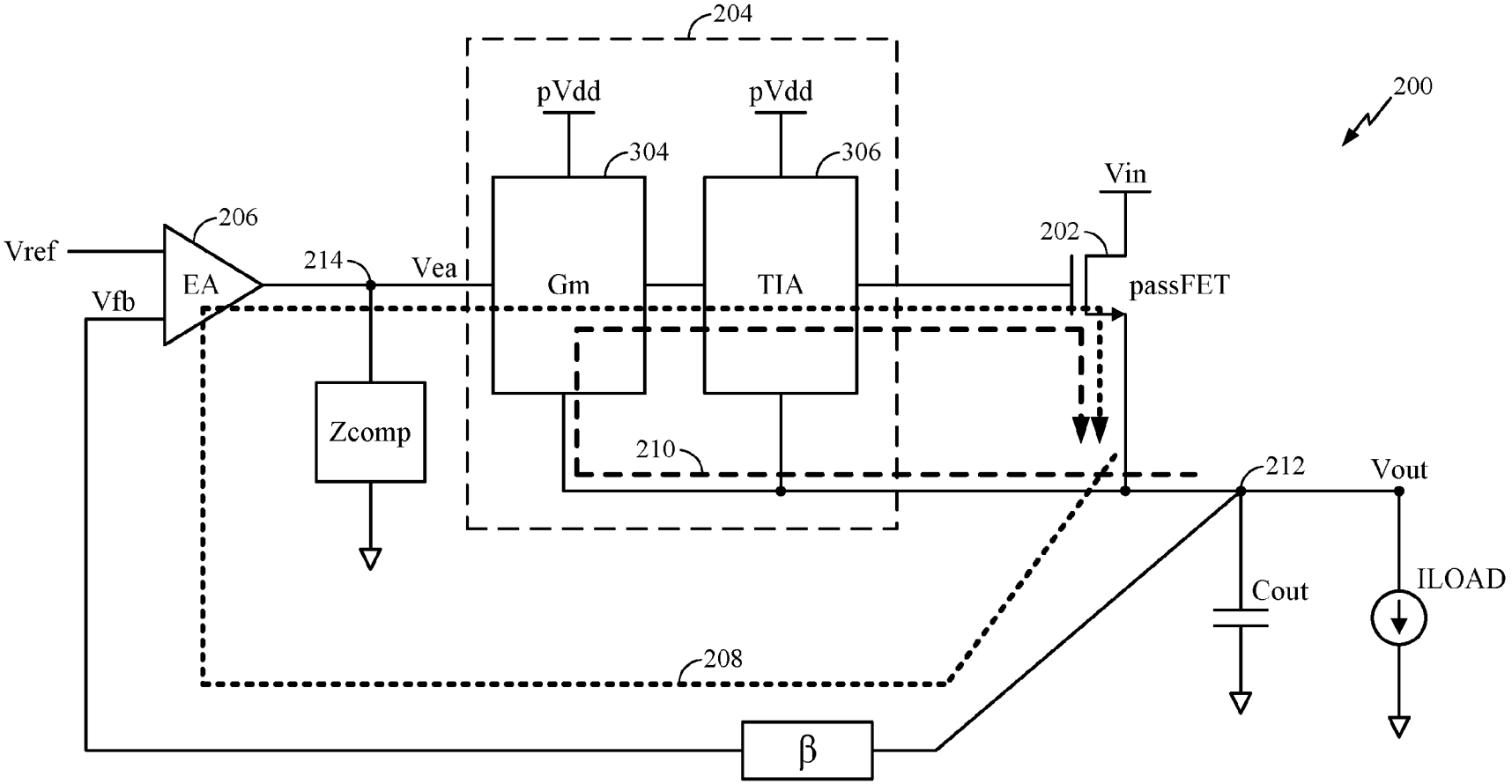
FIG. 3 illustrates an example implementation of a buffer of the dual-loop regulator of FIG. 2, in accordance with certain aspects of the present disclosure.

FIG. 3 illustrates an example implementation of the buffer 204 of the regulator 200, in accordance with certain aspects of the present disclosure. The buffer 204 may include a transconductance (Gm) stage 304 and a transimpedance amplifier (TIA) 306. As illustrated, both the Gm stage 304 and the TIA 306 are coupled to the output node 212. In certain aspects, the Gm stage 304 may generate a current based on the reference voltage Vea and the output voltage Vout at the output node 212. For example, the current generated by the Gm stage 304 may be a function of the difference between the reference voltage Vea and the output voltage Vout. For example, as the difference between the reference voltage Vea and the output voltage Vout increases, the current generated by the Gm stage 304 also increases, as will be described in more detail with respect to FIG. 4. The TIA 306 may amplify the current generated by the Gm stage 304, and drive the transistor 202 via a control voltage generated at the gate of the transistor 202.

Figure 4:
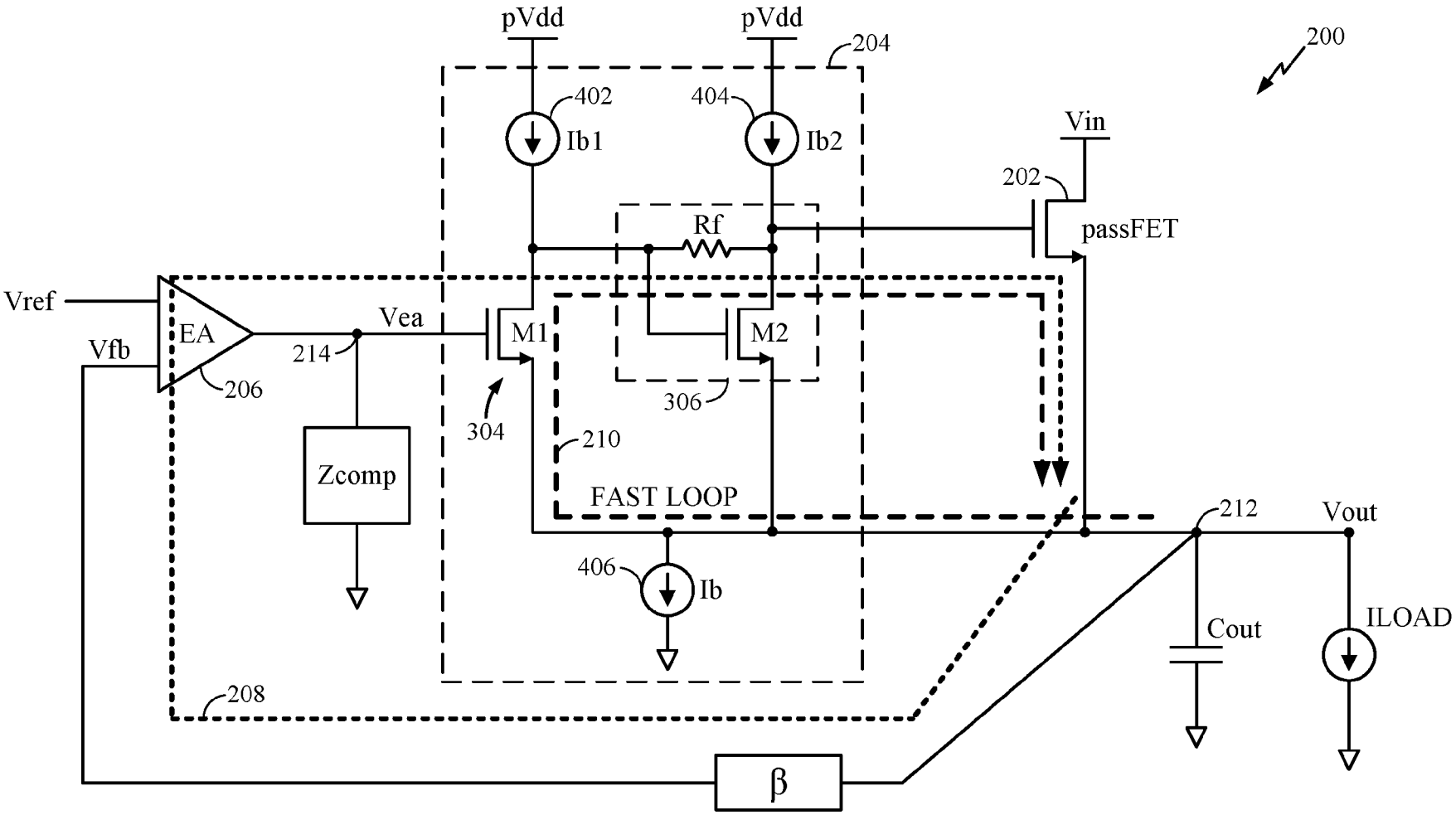
FIG. 4 illustrates an example implementation of a transconductance (Gm) stage and the transimpedance amplifier (TIA) of the dual-loop regulator of FIG. 2, in accordance with certain aspects of the present disclosure.

FIG. 4 illustrates an example implementation of the Gm stage 304 and the TIA 306 of the regulator 200, in accordance with certain aspects of the present disclosure. For example, the Gm stage 304 may be implemented using a transistor M1. In certain aspects, a gate of the transistor M1 may be coupled to the node 214 and a source of the transistor M1 may be coupled to the output node 212. Thus, the gate to source voltage (Vgs) of the transistor M1 may be equal to, and the drain current of the transistor M1 may be a function of, the difference between the reference voltage Vea and the output voltage Vout.

In certain aspects, a current source 402 may be coupled to the drain of the transistor M1 and generate a bias current Ib1. As illustrated, the current source 402 is coupled to both the feedback path 208 and feedback path 210. A current, generated based on the difference between the drain current of transistor M1 and the bias current Ib1, may be amplified by the TIA 306, which may be implemented using a transistor M2 and an impedance Rf (e.g., a resistance). For example, when there is a load attack (e.g., ILOAD increases), the output voltage Vout decreases (e.g., dips). Since the output node 212 is coupled to the source of the transistor M1 via the feedback path 210, the gate to source voltage (Vgs) of the transistor M1 increases, resulting in an increase of the drain current of the transistor M1. The TIA 306, which is implemented in FIG. 4 with the transistor M2 and impedance Rf, amplifies the increased drain current of transistor M1. For example, the increased drain current of transistor M1 may flow across the impedance Rf, increasing the control voltage at the gate of the transistor 202, and thus, allowing transistor 202 to supply increased load current to the output node 212.

Therefore, the TIA 306 provides gain for the feedback path 210 while keeping the internal node impedance of the feedback path 210 low. The feedback path 210 (e.g., fast loop) allows for a quicker response to the decrease in the output voltage. Moreover, the bias currents Ib1 and Ib2 generated by current sources 402 and 404 may be maintained independent of ILOAD, easing stability challenge at light load. In certain aspects, a current source 406 may be coupled between the output node 212 and a reference potential (e.g., ground potential) of the regulator 200 to generate a bias current Ib.

The feedback path 208 also responds to the decrease in the output voltage Vout, albeit more slowly than the feedback path 210. That is, the amplifier 206 responds to the decrease in the output voltage Vout and adjusts the reference voltage Vea accordingly. For example, the amplifier 206 adjusts the reference voltage Vea until the reference voltage Vea eventually settles to a higher value, which then serves as the new reference for the buffer 204 and the feedback path 210.

The feedback path 208 may be compensated by the dominant pole at the output of the amplifier 206, which is a relatively slowly moving signal that may be insensitive to parasitics. The feedback path 210, however, resides in the power stage and allows a relatively faster response to load attacks. Therefore, with the dual loop implementation as described herein, the controller stage may be separated from the power stage, allowing the controller stage to be shared my multiple power stages.

Figure 5:
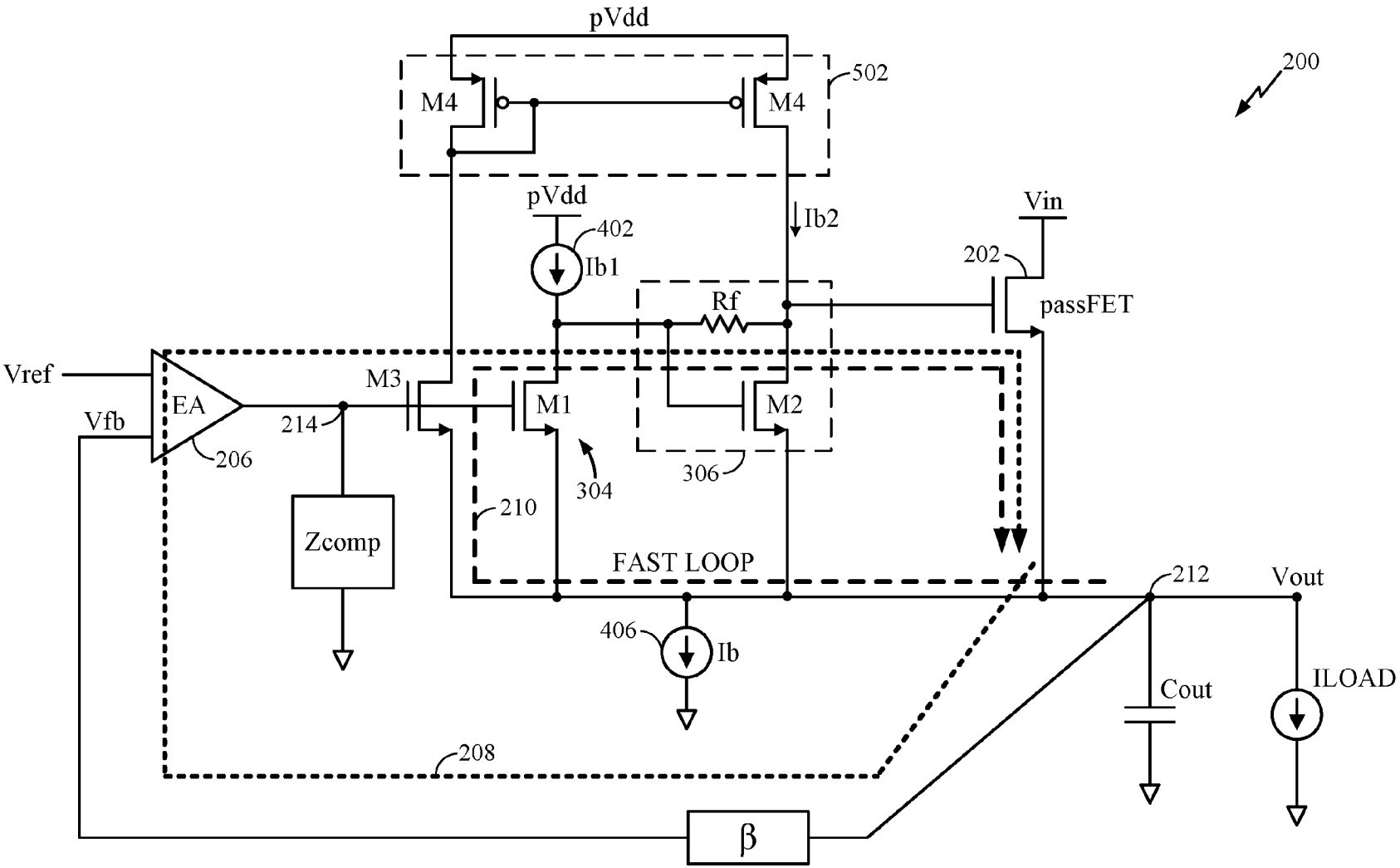
FIG. 5 illustrates an example implementation of the Gm stage and the TIA of FIG. 4 implemented using a current mirror, in accordance with certain aspects of the present disclosure.

FIG. 5 illustrates an example implementation of the Gm stage 304 and the TIA 306 using a current mirror 502, in accordance with certain aspects of the present disclosure. As illustrated, a transistor M3 may be coupled to the transistor M1 such that the Vgs of both transistors M1 and M3 are the same during operation. For example, the gate of transistor M1 may be coupled to the gate of transistor M3 and the source of transistor M1 may be coupled to the source of transistor M3. Thus, when the output voltage Vout decreases (e.g., dips due a load attack), both the drain currents of transistor M1 and transistor M3 increase. The drain current of transistor M3 may be mirrored using the current mirror 502, which may be implemented using transistors M4 and M5, to generate the bias current Ib2 (e.g., as opposed to using a constant current source 404).

At steady state, the drain current of transistor M3 may be equal to the bias current Ib1, and thus, the bias currents Ib1 and Ib2 may be equal. However, when the drain current of transistor M3 increases due to a load attack, the bias current Ib2 increases, allowing the gate capacitance of the transistor 202 to be charged more quickly. Therefore, the push-pull capability of the TIA 306 via the addition of the transistor M3 and the current mirror 502, improves the transient response of the regulator 200. In certain aspects, transistors M1 and M3 may be different sizes. In some cases, transistors M4 and M5 may be different sizes.

Aspects of the present disclosure improve the transient response of the regulator 200. Thus, for the same output capacitor (Cout) size, a faster transient response may be obtained, leading to smaller undershoot and/or overshoot of the output voltage of the regulator in response to a load attack (e.g., increased ILOAD). Therefore, the size of the output capacitor Cout may be reduced reducing bill of material (BOM) costs. Aspects of the present disclosure also allow for a fixed quiescent current that is independent of load current (ILOAD), and thus, improve current efficiency as compared to conventional dynamic bias schemes. Moreover, the buffer 204 provides a wide bandwidth low gain regulation loop, expanding the overall loop gain.

Figure 6:
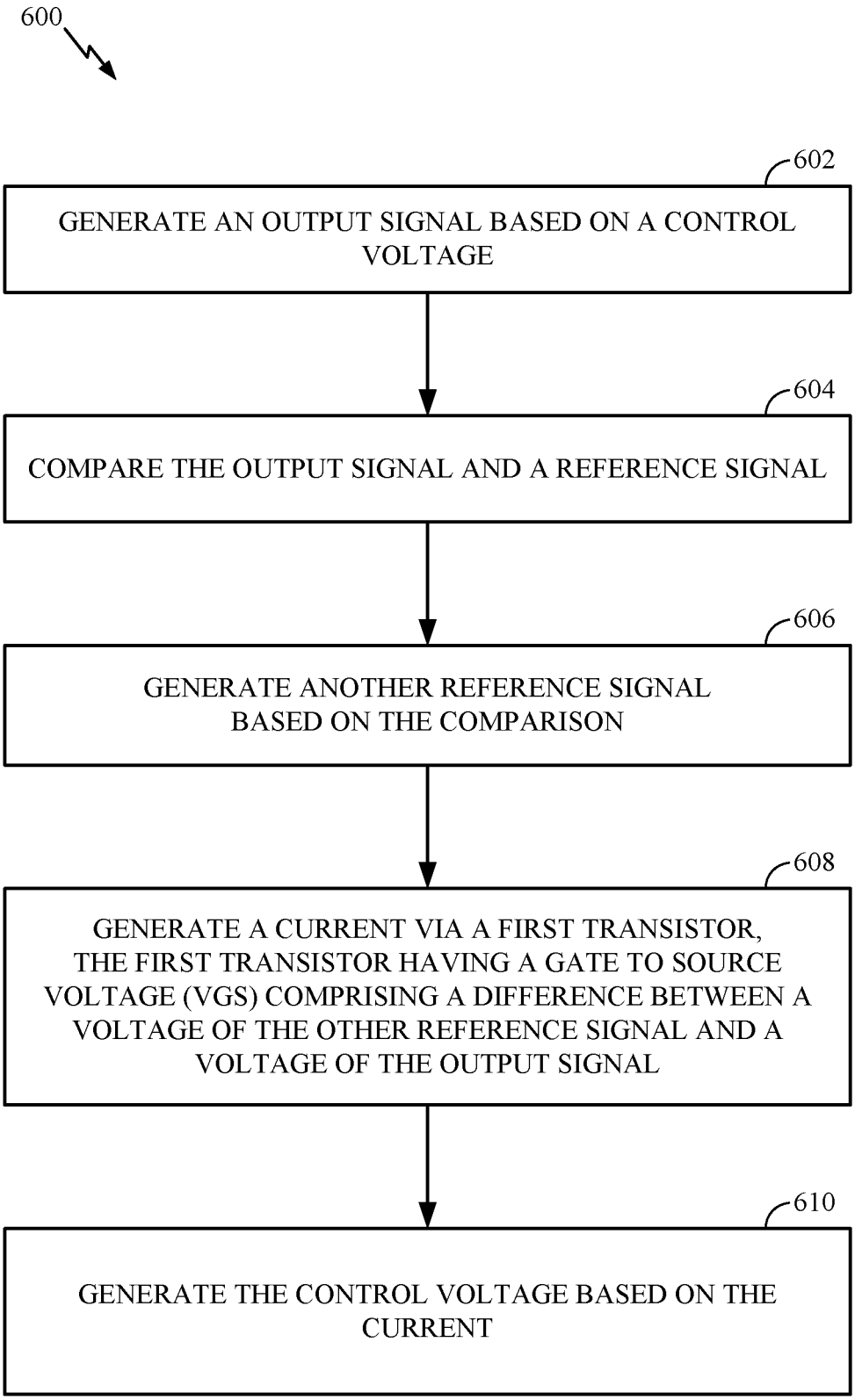
FIG. 6 illustrates example operation for signal regulation, in accordance with certain aspects of the present disclosure.

FIG. 6 illustrates example operations 600 for signal regulation, in accordance with certain aspects of the present disclosure. The operations 600 may be performed by a circuit, such as the circuits of FIGS. 2-5.

The operations 600 begin at block 602 by generating an output signal (e.g., Vout) based on a control voltage, and at 604, by comparing the output signal and a reference signal (e.g., Vref). At block 606, another reference signal (e.g., Vea) may be generated based on the comparison. At block 608, the circuit may generate a current via a first transistor (e.g., transistor M1), the transistor having a gate to source voltage (Vgs) comprising a difference between a voltage of the other reference signal (e.g., Vea) and a voltage of the output signal (e.g., Vout). At block 610, the circuit may generate the control voltage based on the current.

In certain aspects, the current generated by the transconductance stage comprises a drain current of the first transistor. In certain aspects, the operations 600 also include sourcing a bias current (e.g., Ib1) to a drain of the first transistor. In certain aspects, the control voltage may be generated via a second transistor (e.g., transistor M2) and an impedance (e.g., impedance Rf) coupled between a gate of the second transistor and a drain of the second transistor.

In certain aspects, the circuit may generate another current via a second transistor (e.g., transistor M3), wherein a gate to source voltage (Vgs) of the second transistor comprises a difference between a voltage of the other reference signal and a voltage of the output signal. In this case, the operation 600 also include mirroring the other current, wherein generating the control voltage is based on the mirrored other current (e.g., Ib2).

The various operations of methods described above may be performed by any suitable means capable of performing the corresponding functions. The means may include various hardware and/or software component(s) and/or module(s), including, but not limited to a circuit, an application-specific integrated circuit (ASIC), or processor. Generally, where there are operations illustrated in figures, those operations may have corresponding counterpart means-plus-function components with similar numbering. In certain aspects, means for generating may include an amplifier such as the amplifier 206, transistor 202, the Gm stage 304 and/or TIA 306. In certain aspects, means for comparing may include an amplifier such as the amplifier 206.

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules and circuits described in connection with the present disclosure may be implemented or performed with a general purpose processor, a digital signal processor (DSP), an ASIC, a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a wireless node. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement the signal processing functions of the physical (PHY) layer. In the case of a user terminal, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

The processing system may be configured as a general-purpose processing system with one or more microprocessors providing the processor functionality and external memory providing at least a portion of the machine-readable media, all linked together with other supporting circuitry through an external bus architecture. Alternatively, the processing system may be implemented with an ASIC with the processor, the bus interface, the user interface in the case of an access terminal), supporting circuitry, and at least a portion of the machine-readable media integrated into a single chip, or with one or more FPGAs, PLDs, controllers, state machines, gated logic, discrete hardware components, or any other suitable circuitry, or any combination of circuits that can perform the various functionality described throughout this disclosure. Those skilled in the art will recognize how best to implement the described functionality for the processing system depending on the particular application and the overall design constraints imposed on the overall system.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. A regulator, comprising:

a pass transistor having a source coupled to an output node of the regulator, the output node further coupled to a first feedback path and a second feedback path of the regulator;

an amplifier having a first input coupled to the first feedback path and a second input coupled to a reference path;

a transconductance stage having a first transistor and a first current source, the first transistor and the first current source coupled to the first feedback path and the second feedback path; and a transimpedance stage coupled to the transconductance stage and a gate of the pass transistor.

2. The regulator of claim 1, wherein:

the pass transistor is configured to generate an output signal at the output node of the regulator;

the amplifier is configured to compare the output signal from the first feedback path and a first reference signal from the reference path, the amplifier being configured to provide a second reference signal at the output of the amplifier based on the comparison;

the transconductance stage is configured to generate a current based on the second reference signal and the output signal; and the transimpedance stage is configured to generate a control voltage based on the current generated by the transconductance stage, wherein the control voltage drives the gate of the pass transistor to provide the output signal.

3. The regulator of claim 1, wherein the transimpedance stage comprises a second transistor and a second current source, wherein the second transistor and the second current source are coupled to the first feedback path and the second feedback path.

4. The regulator of claim 3, wherein a source of the second transistor is coupled to the output node of the regulator, the transimpedance stage further comprising an impedance coupled between a gate of the second transistor and a drain of the second transistor.

5. The regulator of claim 3, further comprising:

a third transistor coupled to the amplifier and the first feedback path.

6. The regulator of claim 5, wherein a gate of the third transistor is coupled to the output of the amplifier and a source of the third transistor is coupled to the output node.

7. The regulator of claim 5, further comprising:

a current mirror having a first branch coupled to a drain of the third transistor, wherein a second branch of the current mirror is coupled to the drain of the second transistor.

8. The regulator of claim 1, further comprising a second current source coupled between the output node and a reference potential of the regulator.

9. The regulator of claim 1, wherein the pass transistor comprises an n-channel metal-oxide semiconductor (NMOS) transistor having a drain coupled to an input node, and wherein the gate of the pass transistor is coupled to an output of the transimpedance stage.

10. The regulator of claim 1, further comprising:

a second transistor having a gate coupled to the output of the amplifier and a source coupled to the output node.

11. A regulator, comprising:

a pass transistor having a source coupled to an output node of the regulator and a feedback path;

an amplifier having a first input coupled to the feedback path and a second input coupled to a reference path;

a transconductance stage having a first transistor, the first transistor being coupled to an output of the amplifier and a source of the first transistor being coupled to the output node; and a transimpedance stage coupled to the transconductance stage and a gate of the pass transistor.

12. The regulator of claim 11, wherein:

the pass transistor is configured to generate an output signal at the output node of the regulator;

the amplifier is configured to compare the output signal from the feedback path and a first reference signal from the reference path, the amplifier being configured to provide a second reference signal at the output of the amplifier based on the comparison;

the transconductance stage is configured to generate a current based on the second reference signal and the output signal; and the transimpedance stage is configured to generate a control voltage based on the current generated by the transconductance stage, wherein the control voltage drives the gate of the pass transistor to provide the output signal.

13. The regulator of claim 11, further comprising a current source coupled between a drain of the first transistor and a voltage rail of the regulator.

14. The regulator of claim 11, wherein the transimpedance stage comprises:

a second transistor having a source coupled to the output node of the regulator; and an impedance coupled between a gate of the second transistor and a drain of the second transistor.

15. The regulator of claim 14, further comprising a current source coupled between a drain of the second transistor and a voltage rail of the regulator.

16. The regulator of claim 14, further comprising:

a third transistor having a gate coupled to the output of the amplifier and a source coupled to the output node.

17. The regulator of claim 16, further comprising:

a current mirror having a first branch coupled to a drain of the third transistor, wherein a second branch of the current mirror is coupled to the drain of the second transistor.

18. The regulator of claim 14, further comprising a current source coupled between the output node and a reference potential of the regulator.

19. The regulator of claim 11, wherein the pass transistor comprises an n-channel metal-oxide semiconductor (NMOS) transistor having a drain coupled to an input node and wherein the gate of the pass transistor is coupled to an output of the transimpedance stage.

20. The regulator of claim 11, further comprising:

a second transistor having a gate coupled to the output of the amplifier and a source coupled to the output node.

21. A method for signal regulation, comprising:

generating an output signal based on a control voltage;

comparing the output signal and a reference signal;

generating another reference signal based on the comparison;

generating a current via a first transistor, the first transistor having a gate to source voltage (Vgs) comprising a difference between a voltage of the other reference signal and a voltage of the output signal; and generating the control voltage based on the current.

22. The method of claim 21, wherein the current comprises a drain current of the first transistor.

23. The method of claim 21, further comprising sourcing a current to a drain of the first transistor.

24. The method of claim 21, wherein the control voltage is generated via a second transistor and an impedance coupled between a gate of the second transistor and a drain of the second transistor.

25. The method of claim 21, further comprising:

generating another current via a second transistor, wherein a gate to source voltage (Vgs) of the second transistor comprises a difference between a voltage of the other reference signal and a voltage of the output signal; and mirroring the other current, wherein generating the control voltage is based on the mirrored other current.

26. An apparatus for signal regulation, comprising:

means for generating an output signal based on a control voltage;

means for generating a reference signal by comparing the output signal and another reference signal;

a transistor for generating a current, the transistor having a gate to source voltage (Vgs) comprising a difference between a voltage of the reference signal and a voltage of the output signal; and means for generating the control voltage based on the current.

* * * * *